United States Patent [19]

Olivieri

[11] Patent Number: 4,541,147

[45] Date of Patent: Sep. 17, 1985

[54] SKI-BOOT FASTENING DEVICE WITH AN ADJUSTABLE-LENGTH TIE ROD FOR VARYING THE TENSION OF THE FASTENING UNDER LOAD

[75] Inventor: Oliviero Olivieri, Montebelluna, Italy

[73] Assignee: Icaro Olivieri & C. S.p.A., Montebelluna, Italy

[21] Appl. No.: 540,757

[22] Filed: Oct. 11, 1983

[30] Foreign Application Priority Data

Oct. 12, 1982 [IT] Italy ..... 23158/82[U]
Oct. 12, 1982 [IT] Italy ..... 23159/82[U]

[51] Int. Cl.[4] ..... A43C 11/14

[52] U.S. Cl. ..... 24/68 SK; 24/69 SK; 24/70 SK

[58] Field of Search ..... 24/68 SK, 70 SK, 69 SK, 24/71 SK, 70 J, 71 J

[56] References Cited

U.S. PATENT DOCUMENTS

| | | | |
|---|---|---|---|
| 3,182,366 | 5/1965 | Teufel | 24/68 SK |
| 3,295,177 | 1/1967 | Bruckl | 24/70 SK |
| 3,643,295 | 2/1972 | Schoch | 24/70 SK |
| 4,090,278 | 5/1978 | Olivieri | 24/70 SK |
| 4,093,288 | 6/1978 | Suzuki | 24/16 PB |
| 4,395,801 | 8/1983 | Gabrielli | 24/70 SK |
| 4,424,636 | 1/1984 | Everest | 24/69 SK |
| 4,433,457 | 2/1984 | Chalmers, II et al. | 24/68 SK |

FOREIGN PATENT DOCUMENTS

| | | | |
|---|---|---|---|
| 2713156 | 10/1977 | Fed. Rep. of Germany | 24/70 SK |
| 694728 | 9/1965 | Italy | 24/70 SK |

*Primary Examiner*—Victor N. Sakran
*Attorney, Agent, or Firm*—Fleit, Jacobson, Cohn & Price

[57] ABSTRACT

A ski-boot fastening device for allowing the fastening tension to be adjusted under load includes a ring or other similar hook means and a tensioning unit which acts on the hook means through a tie rod comprising a rod-shaped element having a section with a plurality of transverse notches which are longitudinally aligned along the section, a substantially plate-shaped body with a hole extending parallel to the line of action of the tie rod and having dimensions so as to couple with at least the notched section of the rod-shaped element, and a seat formed in the substantially plate-shaped body. The seat opens into the hole in the plate-shaped body, and a locking member is mounted in the seat and guided for movement transverse the hole against the action of spring means so as to releasably engage a notch of the notched section of the rod-shaped element.

14 Claims, 6 Drawing Figures

SKI-BOOT FASTENING DEVICE WITH AN ADJUSTABLE-LENGTH TIE ROD FOR VARYING THE TENSION OF THE FASTENING UNDER LOAD

The present invention relates to a ski-boot fastening device comprising members which allow the adjustment of the fastening tension.

It is known that one of the devices most widely used for the fastening of ski-boots comprises basically a plate having a plurality of hooked seats which are identical and parallel to each other and an arcuate, generally rectangular-sectional metal ring one side of which is intended releasably to engage one of the hooked seats while the other side is fixed to the end of a tensioning unit. A tensioning unit generally comprises a plate-shaped base on which a second-order lever is pivoted, a rod-shaped tie rod having one end pivoted at the point of resistance of the lever and its other end fixed to said side of the metal ring.

It is also known that, while a coarse adjustment of the fastening tension can be achieved by successively engaging the ring with different hooked seats, for fine adjustment of the tension it is necessary to adjust the length of the tie rod. For this purpose, the tie rid is generally formed with a screw-threaded end portion for engaging a nut associated with the metal ring or, in an entirely equivalent manner, the tie rod is made rigid with a nut which engages a threaded shaft associated with the metal ring.

Although advantageous from various points of view, such ski-boot fastening devices have a technical disadvantage linked with the manner in which the fine adjustment of the fastening tension is achieved, which has not been overcome until now.

Indeed, for this adjustment, it is always necessary to disengage the ring from the respective hooked seat, operate the screw-nut coupling between the ring and the tie rod, and then re-engage the ring in the same hooked seat to check the degree of tensioning reached. The desired value is generally achieved after several operations of this type which, particularly when effected under unfavourable conditions generally found during skiing, may discourage the user to the extent of making him desist from carrying out a desired and appropriate adjustment.

The main object of the present invention is to overcome this disadvantage, an object which is achieved by a ski-boot fastening device of the type in which a ring or other similar hook means is acted upon by a tensioning unit through a tie rod, characterised in that the tie rod comprises:

a rod-shaped element having a plurality of transverse notches which are aligned longitudinally along at least one section of the rod-shaped element, a substantially plate-shaped body having a hole extending parallel to the line of action of the tie rod and having dimensions so as to couple with at least the second of the rod-shaped element having notches, a seat formed in the substantially plate-shaped body which opens into the hole, a locking member mounted in the seat and guided for movement transverse the hole against the action of spring means releasably to engage a notch in said section of the rod-shaped element.

In accordance with one embodiment of the device of the invention, the locking member comprises a hook pivoted in the seat and having one part accessible from outside the body, a spring resisting the disengagement of the hook from a notch in the said section of the rod-shaped element.

To advantage, and in accordance with another embodiment, the locking member comprises a slider having one part accessible from outside the body and being provided with an aperture which has transverse dimensions greater than the transverse dimensions of the rod-shaped element, the slider being manually movable, in the seat and against the spring means, between a first position in which the aperture is aligned with the hole and a second position in which the aperture and the hole are not aligned, with the effect of locking the rod-shaped element in correspondence with one of its transverse notches.

Further characteristics and advantages of a ski-boot fastening device according to the invention will become clearer from the description of one embodiment, which follows, purely by way of non-limiting example.

IN THE DRAWINGS

Figure 1:
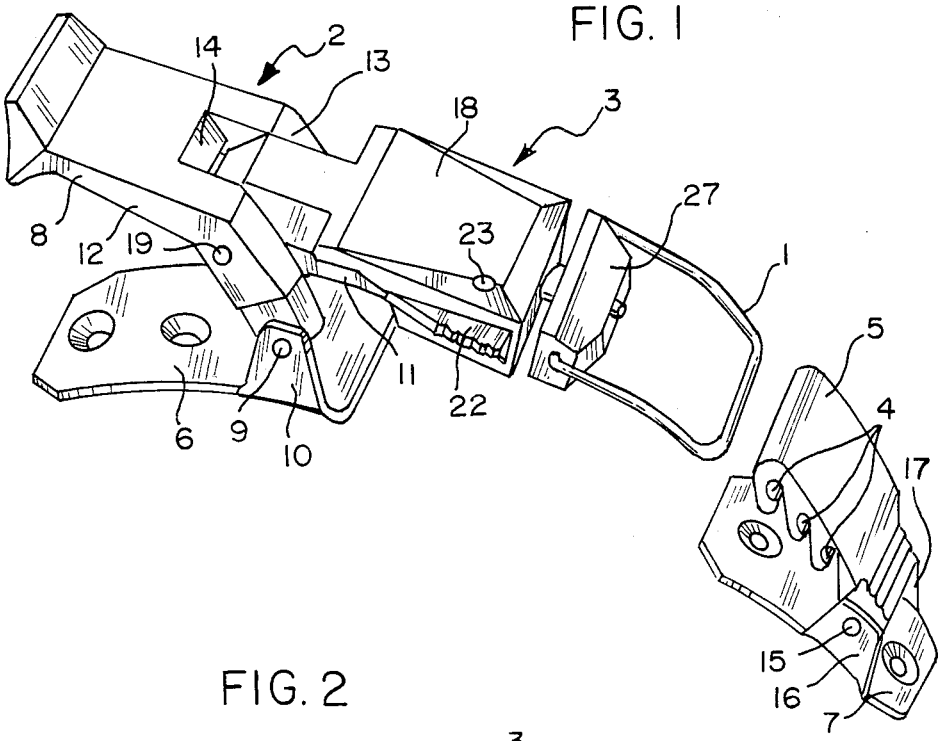
FIG. 1 is a perspective view of a fastening device according to the present invention.
Figure 2:
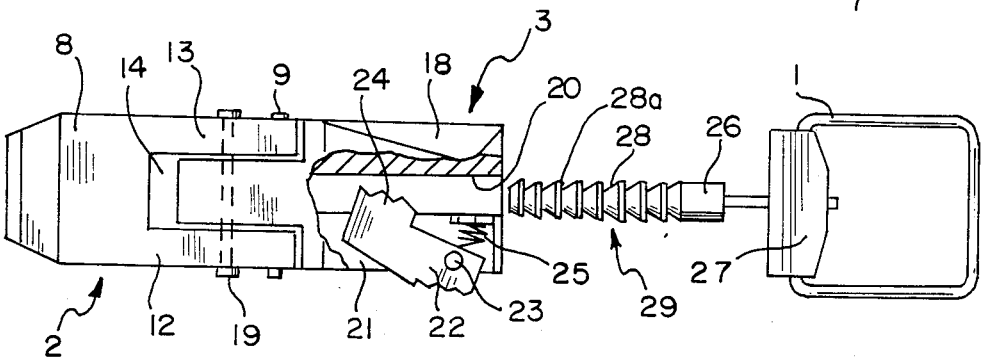
FIG. 2 is a view of a detail of the device of the preceding Figure, with its parts separated and in partial section.
Figure 3:
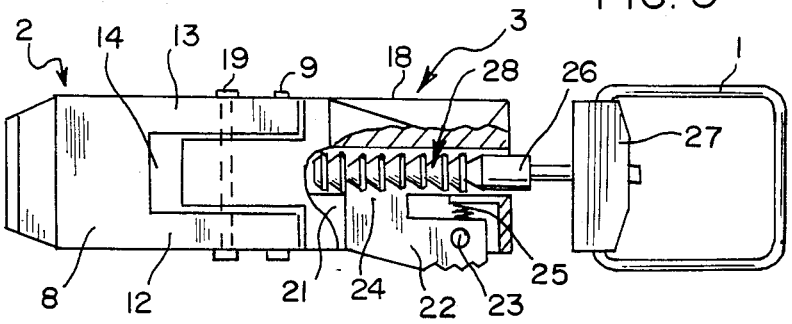
FIG. 3 shows the detail of FIG. 2 in a condition of use.

With reference to the drawings, a ski-boot fastening according to the invention is of the type in which a ring 1 or other similar hook element is acted upon by a tensioning unit, generally indicated 2, through a tie rod 3, and is intended releasably to engage one hooked seat 4 of a plurality of seats with which a plate-shaped lever 5 is provided.

Both the tensioning unit 2 and the plate-shaped lever 5 are fixed in a conventional manner by respective plate-shaped bases 6, 7 in predetermined positions on the upper of a ski-boot (not shown).

More particularly, the tensioning unit 2 is constituted essentially by a second-order lever 8 pivoted on a pin 9 carried by lugs 10, 11 defined by the base plate 6. The lever 8 is of the forked type with prongs 12, 13 which are mutually spaced apart by a distance 14 of predetermined amount.

The plate-shaped lever 5 is also mounted on a pin 15 carried by lugs 16, 17 on the plate-shaped base 7.

The tie rod 3 comprises a plate-shaped body 18 rotatably mounted along one of its transverse sides about a pin 19 carried by the prongs 13, 12 of the lever 8. The plate-shaped body 18 has a hole 20 extending in the direction of the line of force of the tie rod 3. The plate-shaped body 18 is also formed with a seat 21 which opens into the hole 20 and is accessible from outside the aforesaid body 18. In the seat 21 is located a hook 22 which is rotatably mounted on a pin 23 about which the hook is angularly displaceable from a withdrawn position in the seat 21 to a position in which its active end 24 hooks into the hole 20. The hook 22 is biased into this second position (the operative position) by a return spring 25 mounted on the pin 23 and active on the hook in known manner.

The tie rod 3 further includes a cylindrical rod-shaped element 26 having one end attached, for example, fixed or pivoted, to a plate 27 which supports the ring 1 or other similar hook element in conventional manner.

The rod-shaped element 26 has a plurality of transverse, longitudinally-aligned notches 28 on a section 29 of the rod-shaped element itself which includes its end opposite that previously considered.

More particularly, and in accordance with a preferred embodiment, the notches 28 are annular and define a plurality of annular teeth 28*a* in the section 29, the sides of the teeth facing the free end of the rod-shaped element 26 having a conical outward taper.

The second 29 is releasably, axially engageable in the hole 20 of the plate-shaped body 18 described above. Consequently, the hole 20 has a depth and transverse dimensions substantially matching those of the section 29 of the rod-shaped element 26.

The fine adjustment of the degree of fastening tension achieved by the device of the invention may be effected very quickly and simply.

Indeed, for this purpose, it suffices to operate the hook 22 so as to disengage the active end 24 from a notch 28 in which it was previously engaged, and then engage the rod-shaped element 26 in, or disengage it from, its hole 20 in the plate-shaped body 18 as desired, with a consequent variation in the length of the tie rod 3. The new configuration of the tie rod is then fixed by leaving the hook 22 re-engaged in a new notch 28 of the rod-shaped element 26.

It should be noted that this fine adjustment of the degree of fastening tension occurs rapidly and easily when the fastening itself is "under load".

Thus, the characteristic disadvantages of the devices of the prior art, in which the adjustment of the tension of the fastening must be effected under "open" or "loosened" conditions of the device, are advantageously and finally overcome. It should also be noted that the annular shape of the notches 28, and hence of the teeth 28*a*, with radial engagement of these by the hook 22, allows the cylindrical rod-shaped element 26 to rotate about its longitudinal axis.

When these rotations are not desired, it suffices to form the rod-shaped element 26 with a rectangular (or square) cross-section and also form the hole 20 in the plate-shaped body 18 with a rectangular (or square) section.

Finally, it should be noted that the seat 21 with its hook 22 is preferably formed along one side of the plate-shaped body 18. Obviously, the seat 21 may be formed in any other position in the plate-shaped body 18 as long as the hook 22 located therein interferes with the section 29 of the rod-shaped element 26 when engaged in the hole 20.

Figure 4:
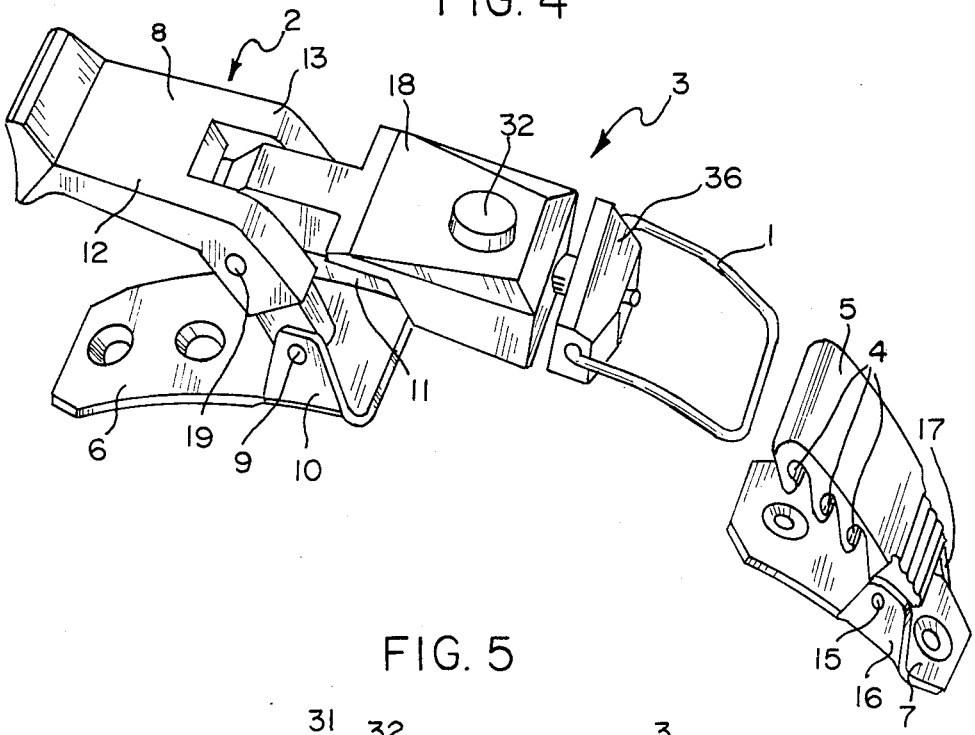
FIG. 4 is a perspective view of a fastening device according to a variant embodiment.
Figure 5:
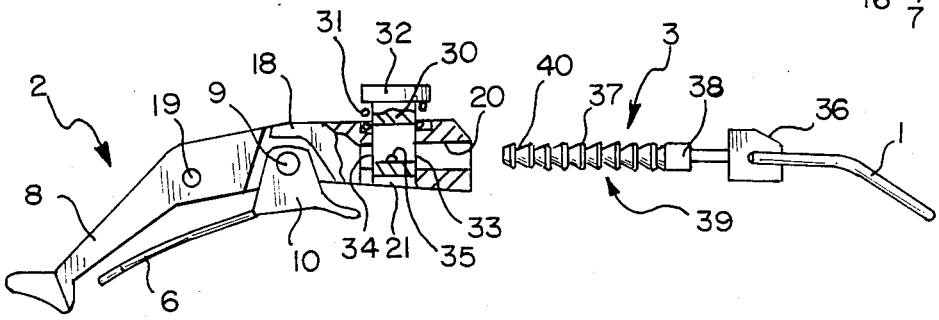
FIG. 5 shows a detail of the device of FIG. 4 with its parts separated and in partial section.
Figure 6:
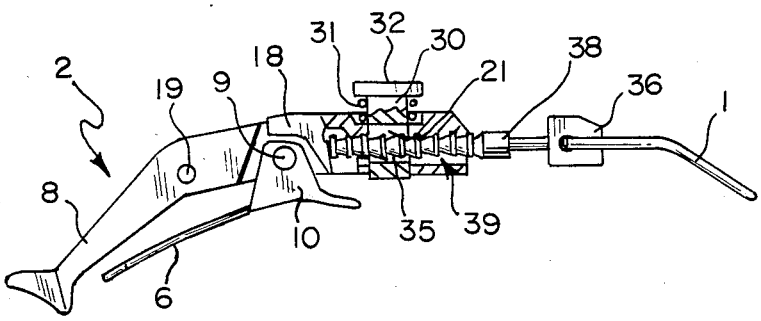
FIG. 6 shows the same detail of FIG. 5 in a condition of use.

According to the variant illustrated in FIGS. 4, 5 and 6, a slider 30 acted upon by a return spring 31 is slidable in the seat 21 in the body 18.

In accordance with a preferred but not exclusive embodiment, the slider 30 has a square cross-section and the cross-section of the seat 21 in which the slider is rotatably engaged is also square. The slider 30 has one end 32 accessible from outside the body 18 and has a through hole constituted by two portions 33, 34 separated by an annular lip 35 of a diameter substantially equal to the diameter of the hole 20. The slider 30 is movable in the seat 21 against the action of the spring 31 between a first position in which the holes 33, 34 are aligned with the hole 20 and a second position in which the holes 33, 34, and 20 are not aligned, the spring 31 biassing towards this second position.

The tie rod 3 further includes a cylindrical rod-shaped element 38 having one end attached, for example, fixed or pivoted, to a plate 36 which supports the ring 1 or other similar hook element.

The rod-shaped element 38 has a plurality of transverse, longitudinally-aligned notches 37 in a section 39 of the rod-shaped element itself, a section which includes the free end of the rod-shaped element.

More particularly, and in accordance with a preferred embodiment, the notches 37 are annular and define a corresponding plurality of annular teeth 40 in the section 39, the sides of which facing the free end of the rod-shaped element 38 have a conical outward taper.

The section 39 is releasably, axially engageable in the hole 20 in the plate-shaped body 18 with simultaneous engagement in the hole 33, 34 of the slider 30. Consequently, the hole 20 has a depth equal to or greater than the length of the section 38, while it has a diameter only slightly greater than the outer diameter of the cylindrical rod-shaped element 38.

For the fine adjustment of the degree of fastening tension achieved according to this variant, it suffices to operate the slider 30 so as to bring it, against the action of the spring 31, into the first position in which the hole 33, 34 is aligned with the hole 20. In this position, the rod-shaped element 38 is free to be engaged in or disengaged from the plate-shaped body 18 as desired, with the consequent variation in length of the tie rod. The new configuration of this tie-rod is then fixed by leaving the slider 30 to take up the position of biassing by the spring 31, in which the holes 33, 34 and 20 are not aligned. In this position, the annular lip 35 within the slider 30 engages a notch 37 of the rod-shaped element.

With regard to the slider 30, it is clear that this may be formed by a plate-shaped element or by an element of similar configuration, or again may have a cylindrical tubular form with means for preventing its rotation in the seat 21, without thereby departing from the scope of the present invention as described above and as claimed below.

What is claimed is:

1. A ski-boot fastening device for allowing the adjustment of the fastening tension under load, of the type including ring-like hook means, a tensioning unit, and a tie rod by means of which the tensioning unit acts on the hook means, wherein the improvement consists in said tie rod comprising:

a rod-shaped element having at least one section with a plurality of transverse notches which are longitudinally aligned therealong;

a substantially plate-shaped body defining a hole which extends parallel to the line of action of said tie rod and has dimensions so as to couple with at least said notched section of the rod-shaped element;

a seat formed in the substantially plate-shaped body and opening into said hole;

a locking member mounted in said seat and guided for movement transverse said hole to releasably engage a notch of said section of the rod-shaped element, and resilient means which oppose the movement of said locking member transverse said hole.

2. A device as defined in claim 1, wherein the locking member comprises a hook pivoted in said seat and having one part accessible from outside the plate-shaped body and a spring resists the disengagement of said hook from a notch of said section of the rod-shaped element.

3. A device as defined in claim 1, wherein said locking member comprises a slider having one end accessible from outside said plate-shaped body and defining an aperture with transverse dimensions greater than the transverse dimensions of the rod-shaped element, said slider being movable manually in said seat between a first position in which said aperture is aligned with said hole and a second position in which said aperture and said hole are out of alignment and said rod-shaped element is locked in correspondence with one of its said transverse notches, spring means opposing said movement of said slider.

4. A device as defined in claim 3, wherein the slider is constituted by a square-sectioned element having a through hole, said through hole being provided internally with an annular lip.

5. A ski-boot fastening device including hook means, a tensioning unit, and a tie rod by which the tensioning unit acts on the hook means, said tie rod comprising:

a rod-shaped element having a circular cross-section and at least one section with a plurality of transverse annular notches which are longitudinally aligned along said rod-shaped element, said notches defining a plurality of annular teeth tapered conically towards a free end of said rod-shaped element for allowing adjustment of the rod-shaped element under a fastening tension;

a substantially plate-shaped body defining a hole extending parallel to the path of travel of said tie rod and is dimensioned to receive at least said notched section of the rod-shaped element;

a seat formed in the substantially plate-shaped body and opening into said hole;

a locking member mounted in said seat and guided for movement transverse said hole to releasably engage an annular notch of said section of the rod-shaped element; and resilient means opposing the movement of said locking member transverse said hole.

6. A device as defined in claim 5, wherein the locking member comprises a hook pivoted in said seat and having one part accessible from outside the plate-shaped body and a spring resists the disengagement of said hook from a notch of said section of the rod-shaped element.

7. A device as defined in claim 5, wherein said locking member comprises a slider having one end accessible from outside said plate-shaped body and defining an aperture with transverse dimensions greater than the transverse dimensions of the rod-shaped element, said slider being movable in said seat between a first position in which said aperture is aligned with said hole and a second position in which said aperture and said hole are out of alignment and said rod-shaped element is locked in correspondence with one of its said transverse annular notches, spring means opposing said movement of said slider.

8. A device as defined in claim 5, wherein the slider comprises a square-sectioned element defining a through hole, said through hole being provided internally with an annular lip.

9. A ski-boot fastening device, said fastening device comprising:

hook means;

a tensioning unit; and tie rod means interconnecting said hook means and said tensioning unit for adjusting the fastening tension between said hook means and said tensioning unit under a load force, said tie rod means comprises a rod-shaped element connected at one end to said hook means and including at least one section with a plurality of transverse notches longitudinally aligned therealong, a body member connected at one end to said tensioning unit and defining a hole extending from the other end of said body member parallel to the path of travel of said tie rod means and dimensioned to receive at least said notched section of the rod-shaped element, a seat formed in the body member and opening into said hole, a locking member mounted in said seat and guided for movement transverse said hole to releasably engage a notch of said section of the rod-shaped element, and resilient means opposing the movement of said locking member transverse said hole for biasing said locking member into engagement with said section of the rod-shaped element when said section is received in said hole under a fastening tension.

10. A device as defined in claim 9, wherein the locking member comprises a hook pivoted in said seat and having one part accessible from outside the body member and a spring resists the disengagement of said hook from a notch of said section of the rod-shaped element.

11. A device as defined in claim 9, wherein the rod-shaped element has a circular cross-section and the notches are annular, said notches defining a plurality of annular teeth.

12. A device as defined in claim 11, wherein said annular teeth have sides which are tapered conically towards the free end of said rod-shaped element.

13. A device as defined in claim 9, wherein said locking member comprises a slider having one end accessible from outside said body member and defining an aperture with transverse dimensions greater than the transverse dimensions of the rod-shaped element, said slider being movable in said seat between a first position in which said aperture is aligned with said hole and a second position in which said aperture and said hole are out of alignment and said rod-shaped element is locked in said hole in correspondence with one of its said transverse notches, spring means opposing said movement of said slider.

14. A device as defined in claim 13, wherein the slider comprises a square-sectioned element defining a through hole, said through hole being provided internally with an annular lip.

* * * * *